US008056566B2

(12) United States Patent
Kang et al.

(10) Patent No.: US 8,056,566 B2
(45) **Date of Patent: *Nov. 15, 2011**

(54) SMOKING ARTICLE WITH REMOVABLY SECURED ADDITIONAL WRAPPER AND PACKAGING FOR SMOKING ARTICLE

(75) Inventors: Joseph Kang, Los Angeles, CA (US); Thomas Kang, Philadelphia, PA (US)

(73) Assignee: National Honey Almond/NHA, Inc., Bristol, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/729,910

(22) Filed: Mar. 23, 2010

(65) Prior Publication Data

US 2010/0212677 A1 Aug. 26, 2010

Related U.S. Application Data

(62) Division of application No. 11/262,181, filed on Oct. 28, 2005, now Pat. No. 7,712,472.

(51) Int. Cl.
*A24C 5/00* (2006.01)
*A24D 1/00* (2006.01)

(52) U.S. Cl. ..... 131/58; 131/67; 131/280; 131/365

(58) Field of Classification Search ..... 131/58, 131/66.1, 67, 280, 360, 365; 229/87.12, 229/87.14

See application file for complete search history.

(56) References Cited

U.S. PATENT DOCUMENTS

| | | | |
|---|---|---|---|
| 569,052 | A | 10/1896 | Pickles |
| 1,373,577 | A | 4/1921 | Vallens |
| 1,458,585 | A | 6/1923 | McCrosson |
| 1,479,458 | A | 1/1924 | de la Mota |
| 2,005,039 | A | 6/1935 | Kayner |
| 2,491,422 | A | 12/1949 | Snyder |
| 3,371,775 | A | 3/1968 | Butler |
| 3,490,576 | A | 1/1970 | Alessi et al. |
| 3,633,589 | A | 1/1972 | Kahane et al. |
| 3,744,496 | A | 7/1973 | McCarty et al. |
| 4,053,046 | A | 10/1977 | Roark |
| 4,225,636 | A | 9/1980 | Cline et al. |
| 4,231,377 | A | 11/1980 | Cline et al. |
| 4,420,002 | A | 12/1983 | Cline |
| 4,443,697 | A | 4/1984 | Ryan et al. |
| 4,450,847 | A | 5/1984 | Owens |

(Continued)

FOREIGN PATENT DOCUMENTS

| | | |
|---|---|---|
| DE | 647715 | 7/1937 |

(Continued)

OTHER PUBLICATIONS

Camino Viejo Tabacos, "Manufacturing Process of the Cigar", <http://cigarhandbook.com/Manufacturing.asp>, Apr. 15, 2004.

*Primary Examiner* — Matthew Daniels

*Assistant Examiner* — Cynthia Szewczyk

(74) *Attorney, Agent, or Firm* — Caesar, Rivise, Bernstein, Cohen & Pokotilow, Ltd.

(57) ABSTRACT

A smoking article includes a tobacco column, a binder surrounding the tobacco column, a first wrapper surrounding the binder, and at least one additional removable wrapper which surrounds the first wrapper and is removably secured to a wrapper beneath the additional removable wrapper. Packaging for a smoking article involves a supportive tube surrounding the smoking article and sealed in a package, where the package is made from a front and a rear sheet sealed together to form a sealed envelope.

16 Claims, 3 Drawing Sheets

U.S. PATENT DOCUMENTS

| | | | |
|---|---|---|---|
| 4,771,795 | A | 9/1988 | White et al. |
| 4,793,367 | A | 12/1988 | Brackmann |
| 4,984,589 | A | 1/1991 | Riedesser |
| 5,143,098 | A | 9/1992 | Rogers et al. |
| 5,143,099 | A | 9/1992 | Le Gars et al. |
| 5,159,944 | A | 11/1992 | Arzonico et al. |
| 5,170,807 | A | 12/1992 | Kasbo et al. |
| 5,749,461 | A | 5/1998 | Guzman |
| 5,899,326 | A | 5/1999 | Benhamou et al. |
| 6,705,326 | B2 | 3/2004 | Rosler |
| 6,722,372 | B1 | 4/2004 | Cantrell |
| 6,742,525 | B2 | 6/2004 | Sinclair, Jr. |
| 6,827,087 | B2 | 12/2004 | Wanna et al. |
| 7,604,008 | B2 | 10/2009 | Gomez |
| 2003/0136705 | A1 | 7/2003 | Roth |
| 2003/0217757 | A1 | 11/2003 | Edelmann |
| 2004/0149298 | A1 | 8/2004 | Moffitt |
| 2005/0039766 | A1 | 2/2005 | Sinclair, Jr. |
| 2006/0000481 | A1 | 1/2006 | Sinclair, Jr. |

FOREIGN PATENT DOCUMENTS

| | | |
|---|---|---|
| DE | 822963 | 11/1951 |
| GB | 1240045 | 7/1971 |
| WO | 00/13534 | 3/2000 |

SMOKING ARTICLE WITH REMOVABLY SECURED ADDITIONAL WRAPPER AND PACKAGING FOR SMOKING ARTICLE

CROSS-REFERENCE TO RELATED APPLICATIONS

This application is a divisional of application Ser. No. 11/262,181 filed on Oct. 28, 2005, now U.S. Pat. No. 7,712,472, entitled SMOKING ARTICLE WITH REMOVABLY SECURED ADDITIONAL WRAPPER AND PACKAGING FOR SMOKING ARTICLE, and whose entire disclosure is incorporated by reference herein.

BACKGROUND OF THE INVENTION

1. Field of Invention

This invention relates to smoking articles and to the packaging for smoking articles, and in particular to a smoking article having improved flavor and burn rate, and packaging to keep the smoking article fresh before smoking without requiring storage in a humidor.

2. Description of Related Art

In the manufacturing of smoking articles, considerable attention has been paid to the wrappers for use in encasing a tobacco rod or other smokeable materials. Much of the focus has been on the reduction of secondary or sidestream smoke which is a by-product of the combustion of a smoking article as well as selective additives to reduce fire propensity. For example, U.S. Pat. No. 4,225,636 (Cline, et al.) teaches the use of carbon coated inner wrappers to significantly reduce sidestream smoke production in the smoking article.

Different wrappers may also effect the burn rate and taste of the smoking article. For example, U.S. Pat. No. 6,827,087 (Wanna et al.) discloses a smoking article with a partial double wrap design intended to affect the burn rate of the smoking article.

While the wrapper material is only a relatively small percentage of the total material in the smoking article much of the taste comes from the wrapper material. U.S. Pat. No. 4,225,636 (Cline et al.) and U.S. Pat. No. 4,505,282 (Cogbill et al.) teach taste improvement in a smoking article by using a carbon inner liner in a smoking article.

Spotting of smoking article wrappers may occur over time due to a number of different factors, and has also been a focus of smoking article manufacturers. U.S. Pat. No. 6,722,372 (Cantrell) teaches the use of an inner wrap comprised of wood fibers and flax fibers in order to reduce such spotting.

One factor which may accelerate spotting on a wrapper of a smoking article is exposure to improper temperature and humidity conditions during transportation and storage. Humidors are a popular solution for this problem, as they provide a humidity controlled environment for storing smoking articles. However, humidors are expensive, and do not provide easily transportable storage for smaller numbers of smoking articles.

U.S. Pat. No. 5,749,461 (Guzman) teaches an airtight cigar package made up of rectangular transparent front and rear sheets, which are heat-sealed together to form an airtight envelope. Four individually wrapped cigars are sealed in the package with support members between and alongside the cigars to prevent crushing of the cigars during package transport and storage.

U.S. Pat. No. 3,371,775 (Butler) teaches a cigar packaging in the form of a film or sheet of synthetic resinous thermoplastic material wherein each elongate object is disposed in a separate compartment formed by the sealing of the film or sheet to a generally like film or sheet. Each compartment can be readily opened in sequence and the contents removed without disturbing the hermetic seal of the remaining containers.

It is desired that the consumer be able to choose the complexity of a smoking article according to his or her individual preferences by way of a smoking article featuring multiple removable wrappers, which when removed, can change the taste and burn rate of the smoking article.

It is also desired that the smoking article be packaged in way that is convenient to store and transport while maintaining the smoking article's freshness and protecting it from damage.

It is further desired that the smoking articles be individually packaged.

BRIEF SUMMARY OF THE INVENTION

The present invention is a smoking article with at least one removable wrapper. The invention also includes a method for assembling a smoking article with at least one removable wrapper. Additionally, the invention includes a packaging for a smoking article, and a method for assembling a packaging for a smoking article.

There are many embodiments and variations of the smoking article. A first embodiment is a smoking article including a tobacco column, surrounded by a binder, surrounded by a first wrapper, and surrounded by at least one additional removable wrapper which is removably secured to the layer beneath it.

In a variation of this embodiment, the at least one additional removable wrapper each has a tab made of an end corner of the wrapper which is folded inward toward the tobacco column, and the wrapper is removably secured by an adhesive between the tab and a layer immediately beneath the tab.

In another variation of this embodiment, the smoking article is surrounded by a supportive tube and sealed in a package, which is made from a front and a rear sheet that are sealed together to form a sealed envelope.

In another variation of this embodiment, the smoking article is surrounded by a flexible plastic supportive tube and sealed in a package, which is made from a front and rear sheet that are sealed together to form a sealed envelope.

In another variation of this embodiment, the smoking article is surrounded by an open-ended supportive tube and sealed in a package, which is made from a front and rear sheet that are sealed together to form a sealed envelope.

In another variation of this embodiment, the smoking article is surrounded by a supportive tube and sealed in a package, which is made from a front and rear foil sheet that are sealed together to form a sealed envelope.

In another variation of this embodiment, the smoking article is surrounded by a supportive tube and sealed in a package, which is made from a front and rear sheet that are hermetically sealed together to form a sealed envelope.

In another variation of this embodiment, the smoking article is surrounded by a supportive tube and individually sealed in a package, which is made from a front and rear sheet that are sealed together to form a sealed envelope.

In another variation of this embodiment, the binder and the first wrapper are connected to each other by overlapping an end of the binder with an end of the first wrapper to form overlapping layers, and applying an adhesive between the overlapping layers so that the connected binder and first wrapper may be rolled as a continuous sheet.

A second embodiment of the invention is a smoking article including a tobacco column, a binder surrounding the tobacco column, and a first wrapper surrounding the binder, where the binder and the first wrapper are connected to each other by overlapping an end of the binder with an end of the first wrapper to form overlapping layers, and applying an adhesive between the overlapping layers such that the connected binder and first wrapper may be rolled as a continuous sheet.

Another aspect of the invention is a packaging for a smoking article, including a supportive tube surrounding the smoking article and sealed in a package, where the package is made from a front and a rear sheet that are sealed together to form a sealed envelope.

In one variation of the packaging aspect of the invention, the supportive tube is made of flexible plastic. In another variation, the supportive tube is open-ended. In another variation, the front and rear sheet are made of foil. In another variation, the front and rear sheet are hermetically sealed. In another variation the smoking article is individually sealed in the packaging.

Another aspect of the invention is the method for assembling a smoking article. A first embodiment of the method for assembling a smoking article involves providing a tobacco column, surrounding the tobacco column with a binder, surrounding the binder with a first wrapper, and surrounding the first wrapper with at least one additional removable wrapper removably secured to a wrapper beneath the additional removable wrapper.

A variation of the first embodiment of a method for assembling a smoking article also includes removably securing the at least one additional removable wrapper to a wrapper beneath the additional removable wrapper with an adhesive. Another variation also includes connecting the binder and the first wrapper to each other by overlapping an end of the binder with an end of the first wrapper to form overlapping layers, and applying an adhesive between the overlapping layers such that the connected binder and first wrapper may be rolled as a continuous sheet.

A second embodiment of the method involves providing a tobacco column, surrounding the tobacco column with a binder, surrounding the binder with a first wrapper, surrounding the binder with at least one additional removable wrapper, where the at least one additional removable wrapper each has a tab formed from an end corner of the additional removable wrapper which is folded inward toward the tobacco column, and removably securing the at least one additional removable wrapper to a wrapper beneath it with an adhesive between the tab and a layer immediately beneath the tab.

A third embodiment of the method involves providing a tobacco column, surrounding the tobacco column with a binder, surrounding the binder with a first wrapper, surrounding the first wrapper with at least one additional removable wrapper removably secured to a wrapper beneath the additional removable wrapper, surrounding the smoking article with a supportive tube, and sealing the smoking article in a package, where the package is made from a front and a rear sheet which are sealed together to form a sealed envelope.

A fourth embodiment of the method involves providing a tobacco column, surrounding the tobacco column with a binder, surrounding the binder with a first wrapper, surrounding the first wrapper with at least one additional removable wrapper, which is removably secured to a wrapper beneath the additional removable wrapper, where the at least one additional removable wrapper each has a tab comprising an end corner of the at least one additional removable wrapper which is folded inward toward the tobacco column, removably securing the at least one additional removable wrapper to a wrapper beneath it with an adhesive between the tab and a layer immediately beneath the tab, surrounding the smoking article with a supportive, open-ended tube, and individually sealing the smoking article in a package, where the package is formed from a front and a rear foil sheet which are hermetically sealed together to form a sealed envelope.

A variation of this fourth embodiment of the method also involves connecting the binder and the first wrapper to each other by overlapping an end of the binder with an end of the first wrapper to form overlapping layers, and applying an adhesive between the overlapping layers such that the connected binder and first wrapper may be rolled as a continuous sheet.

A fifth embodiment of the method involves providing a tobacco column, surrounding the tobacco column with a binder, and surrounding the binder with a first wrapper, where the binder and the first wrapper are connected to each other by overlapping an end of the binder with an end of the first wrapper to form overlapping layers, and applying an adhesive between the overlapping layers such that the connected binder and first wrapper may be rolled as a continuous sheet.

Another aspect of this invention involves a method for assembling a packaging for a smoking article. This aspect involves surrounding the smoking article with a supportive tube, and sealing the smoking article in a package, where the package is made from a front and a rear sheet, where the front and rear sheets are sealed together to form a sealed envelope.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Although the present invention is described herein with respect to cigars, persons skilled in the art will recognize that the invention also is applicable to other smoking articles, including but not limited to cigarettes.

Smoking articles, specifically cigars, generally consist of a tobacco filler material, a surrounding binder holding the tobacco filler material together, and an exterior cover which is known as a wrapper. Generally, cigars are covered with one wrapper that is not removable. The cigars of the present invention have multiple removable wrappers. The outer wrapper is removably secured to the cigar in such a way as to make it easily removable.

Although the wrapper material is only a relatively small percentage of the total material in the cigar, much of the taste comes from the wrapper material. By removing a wrapper, a person can control the burn speed and temperature of the burning of the cigar, which allows for different complexity of smoke. A slower burn has a strong complexity that is sweeter and smoother, while a faster burn tends to be less complex and has a toastier flavor. In this way, the present invention allows a person to easily and conveniently alter a cigar to suit his or her mood and smoking time frame.

In addition, the cigars of the present invention are packaged in sealed envelopes to maintain the quality and freshness of the cigar. Cigars can often become damaged during shipping and storage due to improper humidity and temperature, or being crushed or smashed. Cigars that are subjected to humidity that is higher or lower than the ideal conditions for a cigar can develop spotting on the wrapper and can lose flavor and become stale. Often, cigars are stored in humidity-controlled environments in wooden humidors. However, humidors are expensive and are impractical for transporting one or a few cigars with a person during short trips. The present invention features a supportive tube which surrounds the cigar to help it keep its shape and protect against being crushed during storage or transportation. The tube and cigar are then sealed in an envelope to maintain proper humidity and freshness. This packaging is easily transportable and eliminates the need for an expensive humidor.

Figure 1:
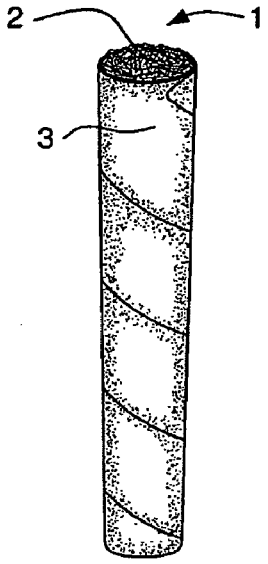
FIG. 1 illustrates a smoking article comprising a tobacco rod surrounded by a binder.
Figure 2:
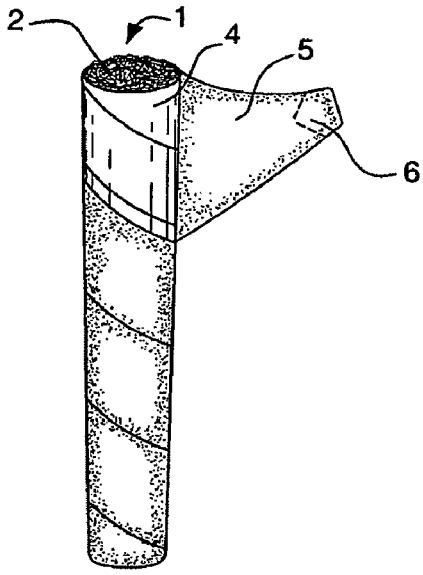
FIG. 2 illustrates a smoking article comprising a tobacco rod surrounded by a binder (not shown), a first wrapper, and an additional removable wrapper with a tab for securing the additional wrapper to the layer beneath it.
Figure 3:
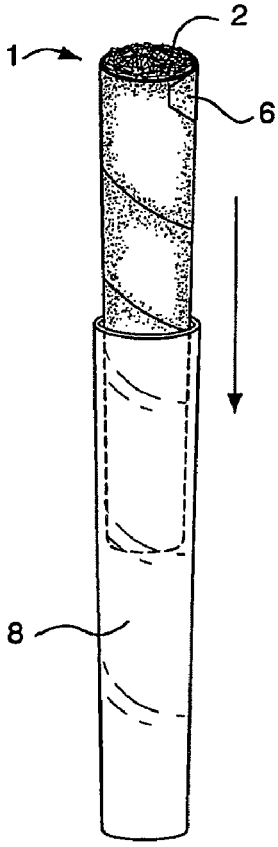
FIG. 3 illustrates a smoking article and a supportive packaging tube surrounding the smoking article.
Figure 4:
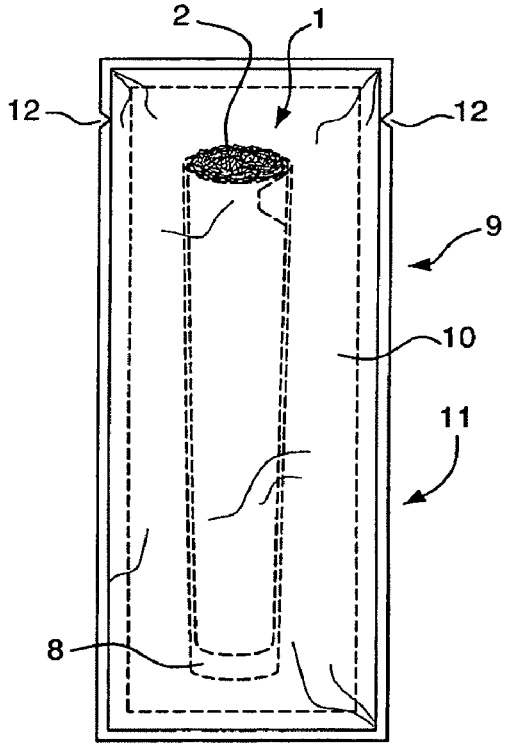
FIG. 4 illustrates a smoking article surrounded by a supportive packaging tube, enclosed in a sealed packaging envelope.

Referring to the drawings, FIGS. 1 and 2 illustrate an embodiment of the smoking article of the present invention and its different layers, while FIGS. 3 and 4 illustrate the packaging of the smoking article.

FIG. 1 shows a smoking article 1 made up of a tobacco column 2, surrounded by a binder 3. The tobacco column can be made up of any type of tobacco filler material, and is held in a column-shape by the binder 3, which surrounds the tobacco column 2 and is secured in place. The binder 3 typically is rough surfaced, uneven textured natural tobacco or reconstituted tobacco paper, but it is known to persons skilled in the art that other materials may be used.

The binder 3 is then surrounded by a first wrapper 4, as shown in FIG. 2. This first wrapper 4 is surrounded by at least one additional removable wrapper 5. The wrappers 4, 5 commonly are fine, smooth, and slick surfaced with veins. The wrappers 4, 5 typically are one hundred percent natural tobacco leaf or smooth surfaced reconstituted tobacco, but it is known to persons skilled in the art that other materials may be used.

The first wrapper 4 surrounds the binder 3 and is secured in place. The first wrapper 4 may be either removably or nonremovably secured to the binder 3. The first wrapper 4 is then surrounded by at least one additional removable wrapper 5. The additional removable wrapper 5 is wrapped around the first wrapper 4 and is removably secured around the first wrapper 4. When the additional removable wrapper 5 is wrapped around the first wrapper 4, a tab 6 is created by folding an end corner of the additional removable wrapper 5 inward toward the tobacco column 2. An adhesive is then applied between the tab 6 and the layer beneath the tab 6. The layer beneath the tab 6 will preferably be the first wrapper 4. Alternately, the layer beneath the tab 6 may be the same additional wrapper 5 from which the tab 6 was created. In that case, the additional removable wrapper 5 should be wrapped around the first wrapper tightly enough that it will not unintentionally slip off once secured by the tab 6 and adhesive.

The additional removable wrapper 5 is removably secured in this manner because it will not unintentionally slip or pop off, but can be easily removed by a person if desired by peeling, starting with the tab 6.

Other additional removable wrappers (not shown) may then surround the additional removable wrapper 5. Such additional removable wrappers would each be removably secured to the wrapper beneath it in the same manner as the original additional removable wrapper 5 by creating a tab 6 and securing it to the layer beneath the tab 6 with an adhesive. Theses other additional wrappers may be removed in the same manner as the original additional removable wrapper 5, if desired, by peeling, starting with the tab 6.

The smoking article 1 is then surrounded by a supportive tube 8, as shown in FIG. 3. The tube 8 can be open-ended, closed on one end, or closed on both ends. The tube 8 is for packaging purposes and should be removed before smoking the cigar 1. The tube 8 may be flexible, but rigid enough to support the cigar 1 and lend protection from crushing during transportation or storage. The tube 8 may be made from any suitable material, including but not limited to synthetic plastics. Preferably, the tube 8 should be at least the same length as the cigar 1, and should have a diameter slightly larger than that of the cigar 1 so that the cigar may be slid into the tube 8 without damaging the outermost wrapper, but tight enough that the cigar 1 will not slide out of the tube 8 unintentionally. The tube 8 is preferably a cylinder, but may also be formed from a rectangular sheet rolled and formed into a cylinder shape but not sealed along the meeting edges. As shown in FIG. 3, the cigar 1 is slid into the tube 8 for packaging so that the cigar 1 is surrounded by the supportive tube 8.

As shown in FIG. 4, the cigar 1 surrounded by the supportive tube 8 is enclosed in an envelope-type package 9. The package 9 is formed from a front sheet 10 and a rear sheet 11 which are sealed together, leaving a space for the cigar 1 surrounded by the supportive tube 8. The front and rear sheets 10, 11 are preferably made from a non-porous, moisture-resistant material, such as a foil. The front and rear sheets 10, 11 are preferably hermetically sealed. Notches 12 may be cut on either side of the envelope-type package 9, without compromising the seal, to allow for easier opening of the envelope-type package 9. The envelope-type package 9 may contain more than one cigar 1 each surrounded by a supportive tube 8. Preferably, the envelope-type package 9 contains one cigar 1 surrounded by a supportive tube 8.

Figure 5:
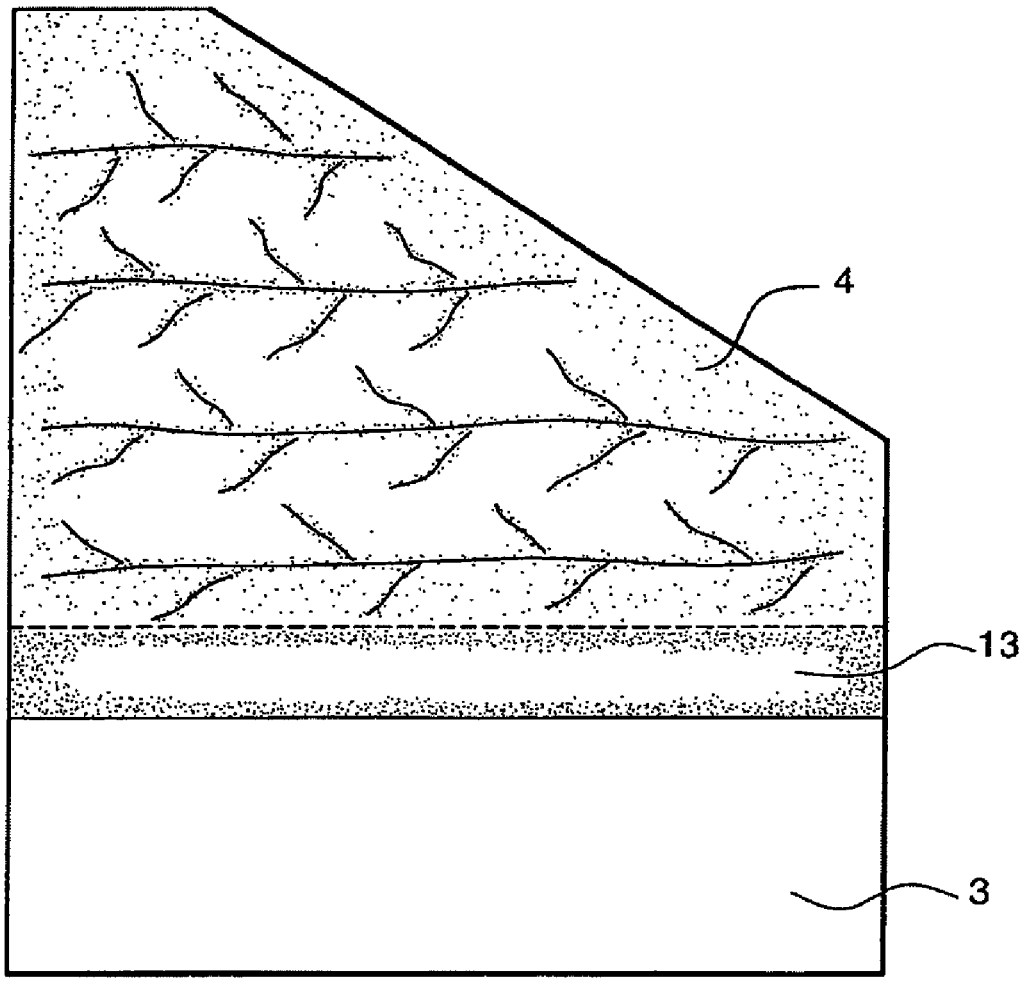
FIG. 5 illustrates a wrapper for a smoking article with a binder glued to one end of the wrapper.
Figure 6:
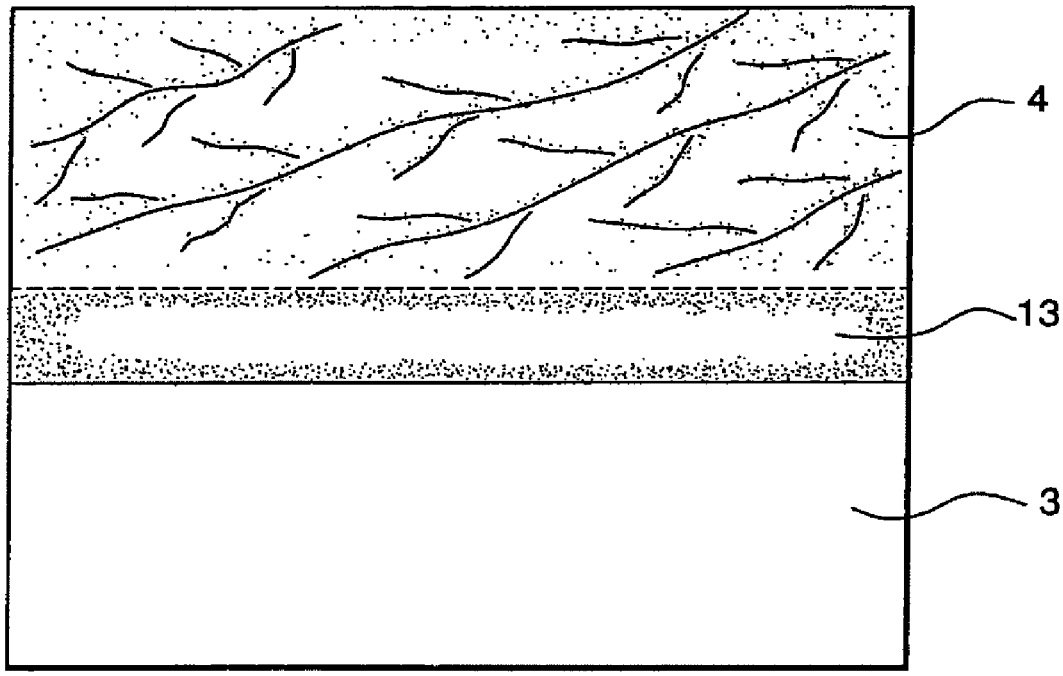
FIG. 6 illustrates another wrapper for a smoking article with a binder glued to one end of the wrapper.

Another embodiment of the invention is illustrated in FIGS. 5 and 6, which show variations of this embodiment using differently shaped wrappers 4. In this embodiment, the wrapper 4 and binder 3 are glued together before the cigar 1 is rolled. To glue the binder 3 and wrapper 4 together, an overlap 13 is formed by placing one end of the binder 3 over one end of the wrapper 4 and applying adhesive between the two overlapping layers. Alternatively, the overlap 13 can be formed by placing one end of the wrapper 4 over one end of the binder 3 and applying adhesive between the two overlapping layers. Once the binder 3 and wrapper 4 are secured, the cigar can be rolled as usual by rolling the binder 3 and wrapper 4 around the tobacco column 2, starting with the binder 3. This embodiment allows for easier rolling of the cigar or other smoking article since the binder 3 and surrounding wrapper 4 can be rolled as a continuous sheet, rather than two separate sheets. Additional wrappers can also be wrapped separately and attached or removably attached around the cigar.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A method for assembling a smoking article, comprising:

providing a tobacco column;

surrounding the tobacco column with a first binder;

surrounding the binder with a first removable wrapper layer as a first continuous sheet including a second binder, a first tobacco wrapper, and an adhesive, said second binder and said first tobacco wrapper being adhesively connected to each other by overlapping an end of the second binder with an end of the first tobacco wrapper to form an overlap at the overlapping ends with the second binder and the first tobacco wrapper extending from the overlap in opposite directions, and by applying the adhesive between the overlapping ends such that said first removable wrapper layer is the first continuous sheet, wrapping said first removable wrapper layer at least once around the first binder, said second binder decreasing the burn rate of the smoking article; and, surrounding the first removable wrapper layer with at least one additional removable wrapper layer, each of said at least one additional removable wrapper layers being an additional continuous sheet including an additional binder, an additional removable tobacco wrapper, and an additional adhesive, said additional binder and said additional removable tobacco wrapper being adhesively connected to each other by overlapping an end of the additional binder with an end of the additional removable tobacco wrapper to form an overlap at the overlapping ends with the additional binder and the additional removable tobacco wrapper extending from the overlap in opposite directions, and by applying the additional adhesive between the overlapping ends such that said at least one additional removable wrapper layer is the additional continuous sheet, wrapping said additional wrapper layer non-adhesively a plurality of times around the first removable wrapper layer such that the additional removable tobacco wrapper is removably secured to the additional removable wrapper layer beneath the additional removable tobacco wrapper, said additional binder decreasing the burn rate of the smoking article.

2. The method of claim 1, further comprising removably securing the additional removable tobacco wrapper to the additional removable wrapper layer beneath the additional removable tobacco wrapper with an adhesive.

3. The method of claim 1, further comprising surrounding the smoking article by a cylindrical supportive tube and sealing the smoking article and the cylindrical supportive tube in a package to form a sealed envelope, the cylindrical supportive tube preventing the cylindrical smoking article from being crushed and having a diameter slightly larger than the diameter of the smoking article to prevent the smoking article from unintentionally sliding out of the cylindrical supportive tube.

4. The method of claim 1, wherein the additional removable tobacco wrapper has a first section and a second section distinct from the first section, the second section including the overlapping end, the first section including a tab comprising an end corner of the additional removable tobacco wrapper spaced from the overlapping end of the additional removable tobacco wrapper, and further comprising folding the tab inward toward the tobacco column, and removably securing the additional removable tobacco wrapper to the additional removable wrapper layer beneath the additional removable tobacco wrapper by an adhesive between the tab and the second section immediately beneath the tab.

5. The method of claim 1, wherein the additional removable tobacco wrapper is removably self-secured to the additional removable wrapper layer wrapper beneath the additional removable tobacco wrapper so as to not unintentionally slip or pop off the additional removable tobacco wrapper.

6. The method of claim 1, including forming the first binder from tobacco.

7. A method for assembling a smoking article, comprising:

providing a tobacco column;

surrounding the tobacco column with a removable wrapper layer as a continuous sheet including a binder, a tobacco wrapper, and an adhesive, said binder and said tobacco wrapper being adhesively connected to each other by overlapping an end of the binder with an end of the tobacco wrapper to form an overlap at the overlapping ends with the binder and the tobacco wrapper extending from the overlap in opposite directions, and by applying the adhesive between the overlapping ends such that said removable wrapper layer is the continuous sheet, wrapping said removable wrapper layer non-adhesively a plurality of times around the tobacco column, said binder decreasing the burn rate of the smoking article;

folding a tab of the tobacco wrapper inward towards the tobacco column, the tab comprising an end corner of the tobacco wrapper distinct from the overlapping end of the tobacco wrapper; and removably securing the tobacco wrapper to the smoking article with an adhesive between the tab and the removable wrapper layer immediately beneath the tab and between the tab and the binder.

8. The method of claim 7, further comprising surrounding the smoking article by a cylindrical supportive tube and sealing the smoking article and the cylindrical supportive tube in a package to form a sealed envelope, the cylindrical supportive tube preventing the cylindrical smoking article from being crushed and having a diameter slightly larger than the diameter of the smoking article to prevent the smoking article from unintentionally sliding out of the cylindrical supportive tube.

9. The method of claim 7, including forming the binder from tobacco.

10. A method for assembling a smoking article, comprising:

providing a tobacco column;

surrounding the tobacco column with a removable wrapper layer as a continuous sheet removably adhered to and surrounding the tobacco column, said removable wrapper layer including a binder, a tobacco wrapper, and an adhesive, said binder having a first end and a second end opposite the first end, said tobacco wrapper having a third end and a fourth end opposite the third end; and adhesively connecting the binder and the tobacco wrapper to each other by overlapping the first end of the binder with the third end of the tobacco wrapper to form an overlap at the overlapping ends with the second end of the binder and the fourth end of the tobacco wrapper distanced from the overlap in opposite directions, and by applying the adhesive between the overlapping first end and third end at the overlap such that the connected binder and tobacco wrapper may be rolled as the continuous sheet, said binder decreasing the burn rate of the smoking article.

11. The method of claim 10, further comprising surrounding the smoking article by a cylindrical supportive tube and sealing the smoking article and the cylindrical supportive tube in a package to form a sealed envelope, the cylindrical supportive tube preventing the cylindrical smoking article from being crushed and having a diameter slightly larger than the diameter of the smoking article to prevent the smoking article from unintentionally sliding out of the cylindrical supportive tube.

12. The method of claim 10, wherein the tobacco wrapper has a first section and a second section distinct from the first section, the second section including the overlapping end, the first section including a tab comprising an end corner of the tobacco wrapper spaced from the overlapping end of the tobacco wrapper, and further comprising folding the tab inward toward the tobacco column, and removably securing the tobacco wrapper to the removable wrapper layer beneath the tobacco wrapper by an adhesive between the tab and the second section immediately beneath the tab.

13. The method of claim 10, wherein the tobacco wrapper is removably self-secured to the removable wrapper layer wrapper beneath the tobacco wrapper so as to not unintentionally slip or pop off the removable tobacco wrapper.

14. The method of claim 10, including forming the binder from tobacco.

15. A smoking article, comprising:

means for providing a tobacco column;

means for surrounding the tobacco column with a first removable wrapper layer as a continuous sheet removably adhered to and surrounding the binder, said removable wrapper layer including a binder, a tobacco wrapper, and an adhesive, said binder having a first end and a second end opposite the first end, said tobacco wrapper having a third end and a fourth end opposite the third end; and means for adhesively connecting the binder and the tobacco wrapper to each other by overlapping the first end of the binder with the third end of the tobacco wrapper to form an overlap at the overlapping ends with the second end of the binder and the fourth end of the tobacco wrapper distanced from the overlap in opposite directions, and by applying the adhesive between the overlapping first end and third end at the overlap such that the connected binder and tobacco wrapper may be rolled as the continuous sheet, said binder decreasing the burn rate of the smoking article.

16. A smoking article, comprising:

a tobacco column; and a removable wrapper layer as a continuous sheet removably adhered to and surrounding the tobacco column, said removable wrapper layer including a binder, a tobacco wrapper, and an adhesive, said binder having a first end and a second end opposite the first end, said tobacco wrapper having a third end and a fourth end opposite the third end, the binder and the tobacco wrapper being adhesively connected to each other by overlapping the first end of the binder with the third end of the tobacco wrapper to form an overlap at the overlapping ends with the second end of the binder and the fourth end of the tobacco wrapper distanced from the overlap in opposite directions, and by applying the adhesive between the overlapping first end and third end at the overlap such that the connected binder and tobacco wrapper may be rolled as the continuous sheet, said binder decreasing the burn rate of the smoking article.

* * * * *